US007909750B2

(12) United States Patent
Howell et al.

(10) Patent No.: US 7,909,750 B2
(45) Date of Patent: Mar. 22, 2011

(54) METHOD AND APPARATUS FOR FEEDING LARGE PACKAGES OR BAGS INTO A RECLOSABLE ZIPPER PROFILE ATTACHING DEVICE

(75) Inventors: Clifton R. Howell, Buford, GA (US); David C. Wallace, Lilburn, GA (US); Adam N. Caplan, Atlanta, GA (US)

(73) Assignee: Illinois Tool Works Inc., Glenview, IL (US)

( * ) Notice: Subject to any disclaimer, the term of this patent is extended or adjusted under 35 U.S.C. 154(b) by 120 days.

(21) Appl. No.: 11/891,697

(22) Filed: Aug. 13, 2007

(65) Prior Publication Data

US 2009/0044492 A1 Feb. 19, 2009

(51) Int. Cl.

| | |
|---|---|
| ***B31B 1/90*** | (2006.01) |
| ***B65H 5/16*** | (2006.01) |
| ***B65H 5/02*** | (2006.01) |
| ***B65G 43/10*** | (2006.01) |

(52) U.S. Cl. ..... 493/213; 198/461.1; 198/576; 198/577; 198/579; 271/271; 271/272; 493/214

(58) Field of Classification Search ..... 53/412, 53/133.4, 139.2, 52, 562; 493/212–214; 383/63, 64; 156/66; 198/418.7, 460.1, 459.1, 198/461.1, 575–577, 579; 271/3.18, 271, 271/272

See application file for complete search history.

(56) References Cited

U.S. PATENT DOCUMENTS

| | | | | |
|---|---|---|---|---|
| 2,883,036 | A * | 4/1959 | Fox et al. | 198/575 |
| 3,827,545 | A * | 8/1974 | Buhayar | 198/579 |
| 4,415,386 | A * | 11/1983 | Ferrell et al. | 493/213 |
| 4,532,193 | A * | 7/1985 | Kniazzeh et al. | 429/82 |
| 5,082,103 | A * | 1/1992 | Ross et al. | 198/460.1 |
| 5,542,802 | A | 8/1996 | Woodman, Jr. | |
| 5,785,310 | A | 7/1998 | Koehn | |
| 5,960,930 | A * | 10/1999 | Hawkins | 198/577 |
| 6,702,281 | B2 * | 3/2004 | Post et al. | 271/258.01 |
| 6,873,882 | B2 * | 3/2005 | Tachibana et al. | 700/230 |
| 7,000,363 | B2 * | 2/2006 | Sosalla et al. | 53/272 |
| 7,238,253 | B2 * | 7/2007 | Ward, Jr. | 493/212 |

FOREIGN PATENT DOCUMENTS

| | | |
|---|---|---|
| DE | 29 34 810 A1 | 3/1981 |
| DE | 20 2005 017869 U1 | 7/2006 |

* cited by examiner

*Primary Examiner* — Stephen F Gerrity
(74) *Attorney, Agent, or Firm* — Day Pitney LLP

(57) ABSTRACT

A device is provided for feeding horizontally oriented packages or bags at a regular interval to a zipper profile attaching device. The loose packages or bags are placed onto a servo-driven lugged chain conveyor wherein the lugs are evenly spaced at the nominal desired center-to-center spacing of the packages or bags. The servo-driven lugged chain conveyor feeds the packages or bags to be captured between upper and lower secondary constant velocity conveyors. The lower secondary constant velocity conveyor includes an encoder which is used to slave the servo of the servo-driven lugged chain conveyor, with an adjustable programmable ratio. This achieves a consistent center-to-center distance of the horizontally oriented packages or bags which are then fed to a zipper profile attaching device.

20 Claims, 1 Drawing Sheet

METHOD AND APPARATUS FOR FEEDING LARGE PACKAGES OR BAGS INTO A RECLOSABLE ZIPPER PROFILE ATTACHING DEVICE

BACKGROUND OF THE INVENTION

1. Field of the Invention

The present invention relates to a method and apparatus for manufacturing large reclosable packages or bags, wherein the reclosable packages are placed onto a conveyor belt with a constant center-to-center distance for the application of reclosable zippers thereon.

2. Description of the Prior Art

The prior art of reclosable packages or bags and the manufacture thereof is well-developed and satisfactory for its intended purposes. In particular, large reclosable packages and the methods of manufacture thereof are disclosed in commonly assigned U.S. patent application Ser. No. 11/728,477 entitled "High Burst Zipper Assembly for Large Reclosable Packages"; U.S. patent application Ser. No. 11/728,405 entitled "Method of Producing High Burst Zipper Assemblies for Large Reclosable Packages" and application Ser. No. 11/728,413 entitled "Hot-melt Adhesive Systems for Zipper Assemblies on Large Bag Constructions of Various Substrates", all filed on Mar. 26, 2007.

However, further improvements are always sought, particularly with respect to the loading of the large reclosable packages or bags onto a conveyor belt so as to achieve a constant center-to-center spacing in preparation for the subsequent placing of reclosable zipper profiles onto the packages or bags. In the prior art, this has been done using a variable speed gearbox and a dynamic conveyor nip. However, it has been found that the use of variable speed gearboxes in this regard has led to deficiencies in accuracy.

OBJECTS AND SUMMARY OF THE INVENTION

It is therefore an object of the present invention to provide a method and apparatus for the loading of packages or bags onto a conveyor belt in order to accurately achieve a constant center-to-center spacing in order to subsequently place the reclosable zipper profiles onto the packages or bags in a way that maintains or improves the manufacturing speeds and manufacturing costs.

This and other objects are obtained by providing a method and apparatus wherein individual or loose packages are placed on a servo-driven, lugged chain conveyor belt. The lugs are formed on the chain at the nominal desired center-to-center distance to be achieved with the packages or bags. The lug chain feeds the individual or loose bags or packages into a constant velocity conveyor belt, which captures the package or bag on both the top and bottom. An encoder is attached to the constant velocity conveyor belt system. This encoder is used to slave the servo-driven lug chain with an adjustable, programmable ratio. By slaving the servo drive to the conveyor, a consistent center-to-center distance can be achieved, and with programming adjustments, the center-to-center distance can be adjusted.

BRIEF DESCRIPTION OF THE DRAWINGS

Further objects and advantages of the invention will become apparent from the following description and from the accompanying drawings and claims, wherein:

DETAILED DESCRIPTION OF THE PREFERRED EMBODIMENTS

Figure 1:
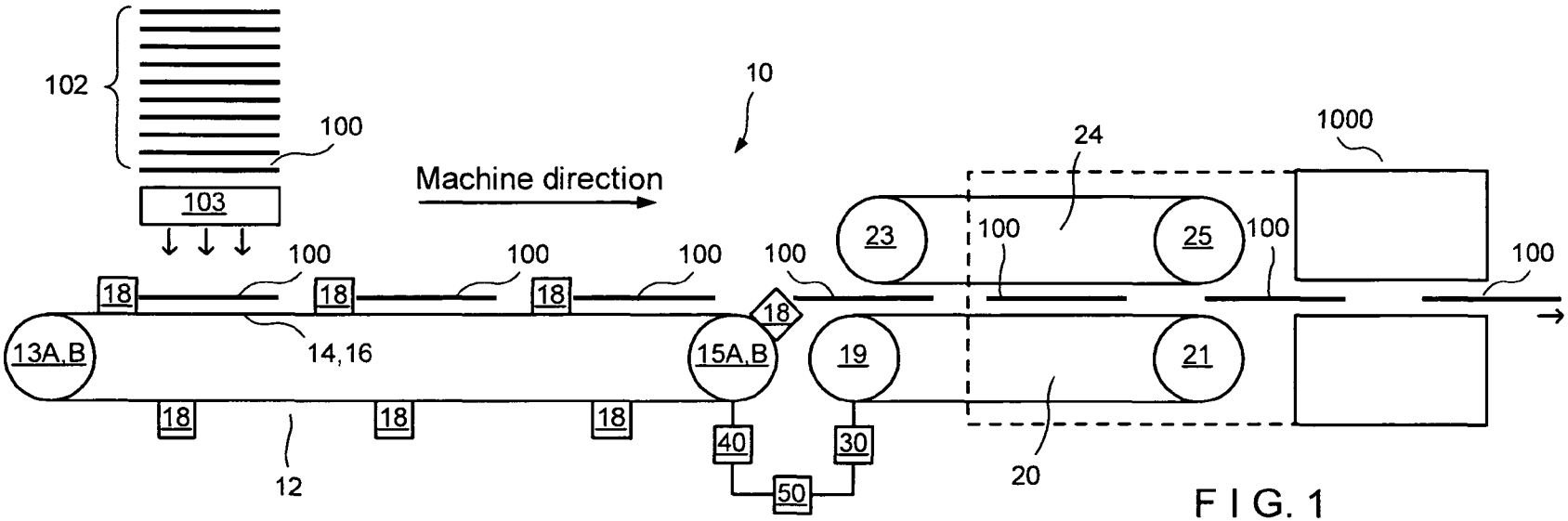
FIG. 1 is a side schematic view of the feeding apparatus of the present invention.

Referring now to the drawings in detail, wherein like numerals refer to like elements, one sees that FIG. 1 is a side schematic view of the feeding apparatus 10 of the present invention.

Loose packages or bags 100 are illustrated as being supplied from stack 102 by a "pick and place" apparatus 103, but stack 102 and apparatus 103 could likewise be replaced with another conveyor belt or other equivalent source. The packages or bags 100 initially provided in stack 102 typically include the walls of the package or bag 100, without the reclosable zipper. The bottom of the package or bag 100 may be open or closed, depending upon the filling configuration. Particularly in view of the horizontal orientation of packages or bags 100 in stack 102, it is envisioned that typically these packages or bags 100 would be empty of the contents (such as a food product, charcoal, animal feed, fertilizer, seeds, etc.) and that subsequent filling steps (not shown) would be used. However, some embodiments of the present invention may include previously filled packages or bags 100.

Figure 2:
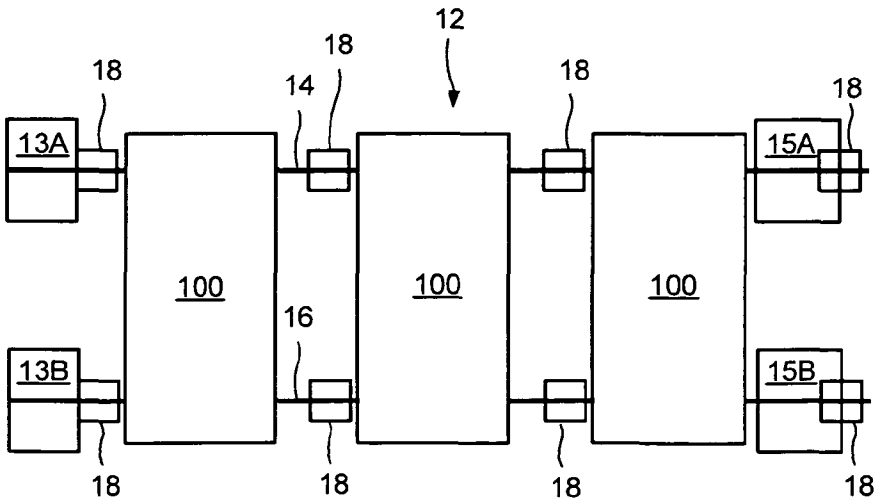
FIG. 2 is a top plan view of the chains with the spaced lugs, used with the present invention.

Packages or bags 100 are periodically dispensed from the stack 102 so as to be placed on moving servo-driven chain conveyor 12. As shown in FIG. 2, moving servo-driven chain conveyor 12 includes first and second sprocket sets 13A, 13B and 15A, 15B (or similar driving apparatus) which drive first and second chains 14, 16. First and second chains 14, 16 includes lugs 18 which are periodically spaced at a distance equal to the nominally desired center-to-center spacing of the packages or bags 100 to be fed to the zipper profile attaching device 1000. As likewise shown in FIG. 2, the sides of packages or bags 100 are oriented in the transverse direction while the tops and bottoms of packages or bags 100 are oriented in the machine direction, as typically required by the zipper profile attaching device 1000.

The packages or bags 100 are conveyed by moving servo-driven chain conveyor 12 and periodically transported onto lower secondary constant velocity conveyor 20, including first and second rolls 19, 21, which likewise transports packages or bags 100. As packages or bags 100 are transferred from servo-driven chain conveyor 12 to lower secondary constant velocity conveyor 20, lugs 18 drop out of the path of packages or bags 100. The point at which lugs 18 drop out of contact with packages or bags 100 is adjustable. Packages or bags 100 are then additionally engaged under upper secondary constant velocity conveyor 24, including first and second rolls 23, 25, thereby capturing the sequence of packages or bags 100 between lower and upper secondary constant velocity conveyors 20, 24, which may be an integral part of attaching device 1000 (see phantom lines in FIG. 1 extending attaching device 1000 over the upper and lower secondary constant velocity conveyors 20, 24) or, in other applications, be separate therefrom.

As shown in FIG. 1, the lower secondary constant velocity conveyor 20 includes encoder 30. Encoder 30 is used to slave the servo 40 of the moving servo-driven chain conveyor 12 with an adjustable programmable ratio as implemented by CPU 50. By slaving the servo 40 of servo-driven chain conveyor 12 to the encoder 30 of lower secondary constant velocity conveyor 20, a consistent nominal center-to-center distance (equal to the spacing between successive lugs 18 on first and second chains 14, 16) between successive packages or bags 100 can be achieved. Moreover, with programming adjustments via the CPU 50, this center-to-center distance can be varied to a different distance, other than the nominal center-to-center distance.

This feeding apparatus 10 thereby provides a sequence of regularly spaced horizontally oriented packages or bags 100 to zipper profile attaching device 1000 for subsequent attachment of the zipper profiles and the finishing of the package or bag.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A method of feeding packages or bags during the manufacture thereof, comprising the steps of:

providing a first conveyor including periodically spaced elements for engaging edges of the package or bags;

periodically loading a sequence of packages or bags onto the first conveyor whereby edges of sequential packages or bags are engaged by sequential periodically spaced elements;

providing a second conveyor, to which the sequence of packages or bags is transferred from the first conveyor, wherein a speed of the first conveyor is slave controlled by a speed of the second conveyor;

urging the sequence of packages or bags against the second conveyor; and providing the sequence of packages or bags to a subsequent manufacturing step.

2. The method of claim 1 wherein the step of loading is performed from a stack of packages or bags.

3. The method of claim 2 wherein the step of loading is performed by pick-and-place apparatus.

4. The method of claim 1 wherein the first conveyor includes at least two chains looped around two rollers.

5. The method of claim 4 wherein the periodically spaced elements are lugs periodically spaced on the at least two chains.

6. The method of claim 1 wherein the step of urging the sequence of packages or bags against the second conveyor is performed by a third conveyor positioned above the second conveyor.

7. The method of claim 1 wherein the first conveyor is driven by a servo.

8. The method of claim 7 wherein the second conveyor includes an encoder.

9. The method of claim 8 wherein the servo is responsive to the encoder, so as to relate a speed of the first conveyor to a speed of the second conveyor.

10. The method of claim 9 further including the step of providing a computing device for varying a relationship between the speed of the first conveyor and the speed of the second conveyor.

11. The method of claim 10 wherein the packages or bags are free of zipper profiles and the subsequent manufacturing step includes attaching zipper profiles to the packages or bags.

12. An apparatus for feeding packages or bags during the manufacture thereof, comprising the steps of:

a first conveyor including periodically spaced elements for engaging edges of the package or bags;

means for periodically loading a sequence of packages or bags onto the first conveyor whereby edges of sequential packages or bags are engaged by sequential periodically spaced elements;

a second conveyor, to which the sequence of packages or bags is transferred from the first conveyor, wherein a speed of the first conveyor is slave controlled by the speed of a second conveyor;

means for urging the sequence of packages or bags against the second conveyor; and means for providing the sequence of packages or bags to a subsequent manufacturing step.

13. The apparatus of claim 12 wherein the means for loading loads from a stack of packages or bags.

14. The apparatus of claim 12 wherein the first conveyor includes at least two chains looped around two rollers.

15. The apparatus of claim 14 wherein the periodically spaced elements are lugs periodically spaced on the at least two chains.

16. The apparatus of claim 12 wherein the means for urging the sequence of packages or bags against the second conveyor is a third conveyor positioned above the second conveyor.

17. The apparatus of claim 12 wherein the first conveyor is driven by a servo and wherein the second conveyor includes an encoder.

18. The apparatus of claim 17 wherein the servo is responsive to the encoder, so as to relate a speed of the first conveyor to a speed of the second conveyor.

19. The apparatus of claim 18 further including the step of providing a computing device for varying a relationship between the speed of the first conveyor and the speed of the second conveyor.

20. The apparatus of claim 19 wherein the packages or bags are free of zipper profiles and the subsequent manufacturing step includes attaching zipper profiles to the packages or bags.

* * * * *